United States Patent [19]

Stole et al.

[11] Patent Number: 4,678,560

[45] Date of Patent: Jul. 7, 1987

[54] SCREENING DEVICE AND PROCESS

[75] Inventors: Kjell A. Stole; Arnstien Lovsland; Egil Havig, all of Lillesand, Norway

[73] Assignee: Norton Company, Worcester, Mass.

[21] Appl. No.: 765,778

[22] Filed: Aug. 15, 1985

[51] Int. Cl.[4] ..... B07B 9/00; B07B 3/00

[52] U.S. Cl. ..... 209/23; 209/28; 209/138; 209/139.2

[58] Field of Search ..... 209/23, 28, 29, 138, 209/139.1, 149, 254, 370

[56] References Cited

U.S. PATENT DOCUMENTS 3,123,551 3/1964 Walker ..... 209/29

FOREIGN PATENT DOCUMENTS 414000 12/1945 Italy ..... 209/139.1
634723 3/1950 United Kingdom ..... 209/139.1
775196 5/1957 United Kingdom ..... 209/28

OTHER PUBLICATIONS

The SWECO Turbo-Screen Classifier Manual revised & printed in 1977.

Article entitled "Screening Machines Can Be Fine--Tuned", from Chemical Engineering Magazine 3/4/1985.

*Primary Examiner*—Andres Kashnikow
*Assistant Examiner*—Patrick N. Burkhart
*Attorney, Agent, or Firm*—Walter Fred

[57] ABSTRACT

A cyclic screening apparatus (10) and method utilizes multiple air flows and differential air pressures to separate undersize and oversize particles from a mixture of 5 to 50 micron size particles. The apparatus (10) comprises a support (12) including a first conduit (14) connected to a blower (16). A lower undersize particle collecting housing (20) has a secondary air inlet (24) and outlet (26) connected to a suction fan (SF). A screen is clamped between the lower housing and an axially movable and pivotable upper receiving housing. An air distributor rotor (R) is slowly rotated below and directs the first air flow through the screen and into the upper chamber and through a lower portion (40) and against the bottom of lower housing. A rotary nozzle (80), with the help of incoming secondary air flow, disperses particulate material onto the screen below. Oversize particles are periodically vacuumed away by a suction fan (SF') drawing a third flow of air into, through and out a slotted collector arm rotated above the screen. In operation the volume of the first air flow, supplied to the air conduit at a predetermined pressure (P3), is less than the combined volume of the first and second flow drawn out of the lower collecting chamber. Thus, the pressure (P1) in the upper chamber is less than the outside atmospheric pressure but greater than the pressure (P2) in the lower chamber.

19 Claims, 3 Drawing Figures

SCREENING DEVICE AND PROCESS

TECHNICAL DISCLOSURE

A cyclic screening device and process utilizing air streams, air fluidization and air pressure differentials has the unique ability to remove small amounts of oversize particles in the micron size ranges with very high degree of precision.

BACKGROUND OF THE INVENTION

1. Field of Invention

The invention relates to an air fluidized screening device and process for screening and separating oversize and undersize micron size particles uniformily distributed onto a static screen and transported through the screen by an air pressure differential assisted gravitational force.

2. Description of the Prior Art

The prior art suggests many types of fluidized screening devices and processes associated with vibratory feeders and screening mediums which have not been entirely satisfactory in the separation of very fine micron size particles.

Fine particulate material has the tendency to easily cake, stick together, and hence clog the device due to the presence of but a slight amount of moisture, molecular attraction and greater surface area. Thus, the particles had to be kept absolutely dry and the fine mesh screen vibrated during the screening process.

The instant invention overcomes the problems of the prior art device and processes by the utilization of air fluidization of the particles and turbulence to maintain the particles separated and in motion and low air differential pressures and sufficient air velocities to draw and pass the desired undersize particles through the screen and remove the oversize particles from the infeed side of the screen.

SUMMARY OF THE INVENTION

A screening device comprising support means including a frame supporting a stationary lower housing with a lower collecting chamber therein and a fixed or variable speed drive motor and gear reduction unit therebelow having an output shaft extending upwardly and rotatable about a central vertical axis of the lower housing and device.

An adjustable air distributing rotor with one or more slotted hollow radial arms is keyed to the output shaft and slowly rotates below a static screen extending horizontally across the chamber to a peripheral frame clamped to an outer flange of the lower housing. Each radial arm is of hollow triangular shape, of which the upper apex edge is slotted and the bottom wall may or may not be perforated to allow a first air flow forced at a predetermined volume into each elongated hollow arm to exit therefrom. At least one hollow radial arm has a lower slotted portion or paddle which produces turbulences in the air flow. Thus, air can pass simultaneously through one or more angularly spaced radial portions of the screen to fluidize radial portions of the layer of particles on the screen at any one time and downwardly to create air turbulences and fluidize the undersize particles collected in the lower chamber. The undersize particles are then drawn out of and carried away from the lower collecting chamber to a cyclone separater and product collector and then to a filtered dust collector with the aid of a second additional air flow of lower volume mixing with the first air flow to create a lower differential pressure and turbulized by striking the lower slotted portion 40 of the rotating hollow radial arm.

Above the screen is an axially movable and pivotable upper receiving housing including an upper receiving chamber and upper outer peripheral flange clamped against the screen frame and removably bolted to the lower housing flange. The upper housing is connected to swing horizontally about the axis of a vertically arranged piston rod of a piston within a fluid cylinder supported by the frame and operable to raise and lower the upper housing relative to the screen frame and lower housing.

A second fixed or variable drive motor and gear reduction unit is vertically mounted on an upper support housing extending upwardly from the upper housing and around the vertical central axis of the device and drive shaft of the gear reduction unit. An internal central bearing divides the support housing into an upper outlet chamber connected to an outlet and lower feed chamber connected to a feed inlet.

The drive shaft of the gear reducer is coupled to the upper closed end of a hollow drive sleeve or tube rotatable within the central bearing and which extends to a lower open end supporting a perforated cone or funnel shape rotary feed distributor ring or nozzle through which the particles and dispersing air can enter.

Inserted into and or attached to the lower open end of the hollow drive sleeve is a vertical tubular leg of an L-shape oversize particle collector arm which has a tubular horizontal leg with an elongated slot in the bottom thereof into which the oversize particles are drawn by a third air flow during operation and rotation thereof above the screen. The oversize particles travel upwardly into and out the collector arm and side aperatures in the hollow drive sleeve to the upper chamber and outlet connected to a cyclone separater and coarse grain collector and optionally onto a filter and dust collector and out a suction fan.

A helical screw feed mechanism is provided surrounded if necessary by a heater to dry and feed the particulate material to and for uniform distribution by rotating distributor nozzle onto the screen by means of gravity aided by a slight dispersion of additional air simultaneously drawn into and passing through the nozzle due to a lower differential pressure and partial vacuum created by the air flowing through the apparatus.

DESCRIPTION OF THE PREFERRED EMBODIMENTS(S)

Figure 1:
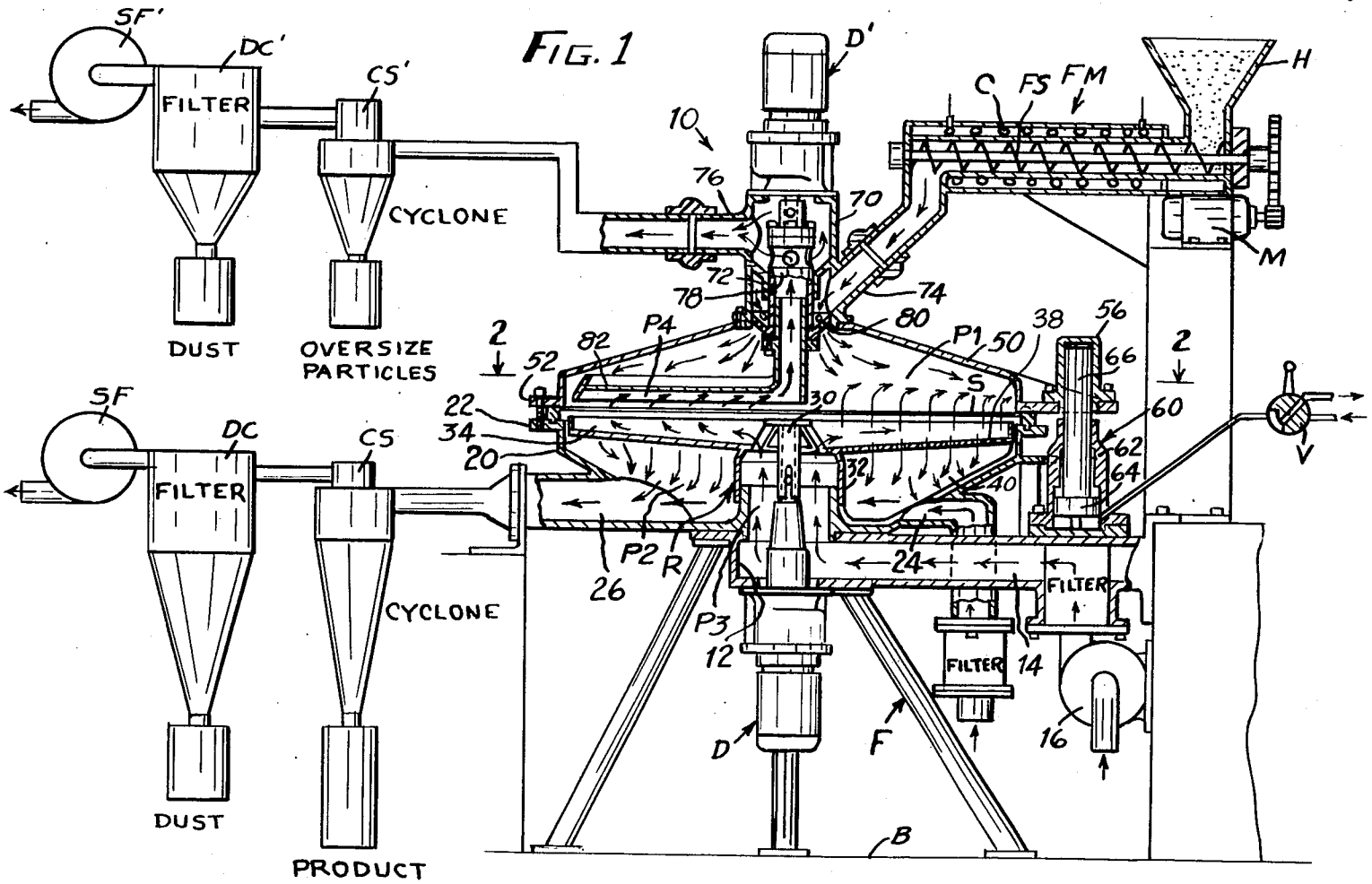
FIG. 1 is a vertical sectional view of the screening device of the invention with portions thereof shown schematically and in elevation.

In FIG. 1 there is shown apparatus for screening of fine particulate material comprising a mixture of particles ranging in size of from 3 to 50 microns, particularly 3 to 30 microns and preferably from 9 to 18 microns.

The apparatus comprises a particle screening device 10 about 112 cm (44") in diameter and 2.134 m (7 ft.) in height having various air inlets connected to a supply of air and air outlets connected to deliver the separated particles to additional conventional cyclone separaters, product collectors, filters and dust collectors.

Means to support the apparatus about a central vertical axis comprises a support frame F including a plurality of support legs and structural members and brackets extending upwardly from a support base B and supporting a lower support housing 12 with an air conduit attached thereto and to an air inlet duct 14 extending horizontally from an air filter in a chamber attached to an adjustable air blower or fan 16, with an air intake, attached to a support extending upwardly from the base B. The blower 16 supplies a relatively greater volume of air into and creates the greater water gauge pressure differential P3 of from 10 to 40 mm of water in the air conduit and duct 24.

Fixed to the lower support wall or bottom of the lower housing 12 are rotor drive means comprising a conventional fixed or variable speed drive motor and gear reduction unit D from which a vertical drive shaft extends upwardly into the air conduit and rotates about an axis aligned with the central axis of the screening apparatus 10.

Mounted upon and fixed to the upper support wall of the lower support housing 12 is a lower undersize particle collecting housing 20 including a conical shape lower collecting chamber within a truncated cone shape bottom or lower wall extending to an outer circular wall fixed to a lower outer annular screen support flange 22 about 112 cm (44") in diameter and having a screen frame locating and retaining groove or recess in its upper surface for the screening means S extending horizontally across the lower collecting chamber.

The lower housing 20 has a filtered air intake duct or conduit 24 extending into the bottom of the lower collecting chamber from an air filter and chamber situated adjacent the open intake end of the duct 24 and an undersize particle outlet duct 26 opposite the intake duct 24. Outlet duct 26 is also connected to an adjustable motor driven suction fan SF which draws air preferably at a greater volume than blower 16 supplies and thus a second additional air flow of lower volume is drawn into duct 24 and it combines with the first air flow to create a water gauge differential pressure P2 of from 5 to 20 mm of water. The fluidized undersize particles suspended in the combined air stream are then carried to a cyclone separator and collector unit CS which separates and collects a greater percentage of the desired heavier and larger undersize or product particles from the air stream which carries the lighter and smaller undersize particles onto a dust collecting and filter unit DC.

Figure 2:
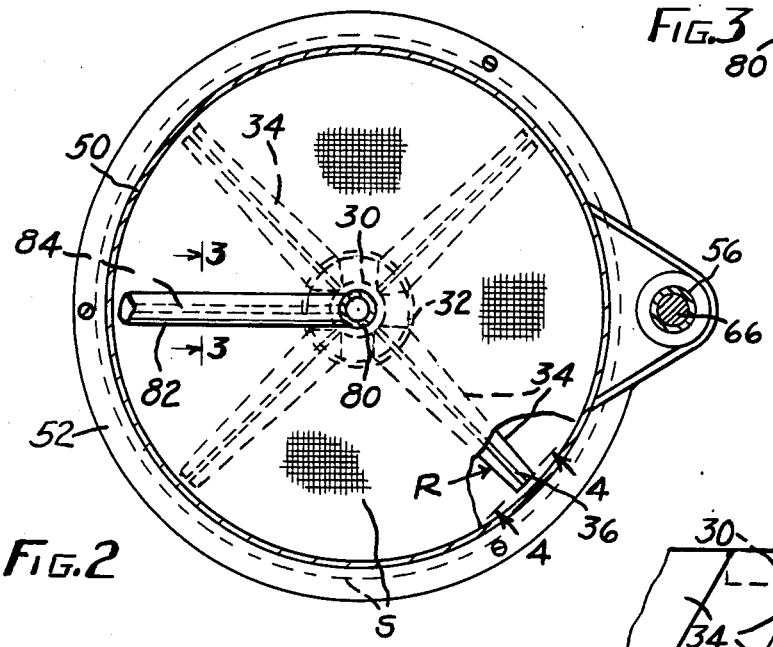
FIG. 2 is a horizontal sectional view taken on line 2—2 of FIG. 1 and showing the air distributing rotor situated below the screen and the oversize particle collecting arm above the screen.
Figure 4:
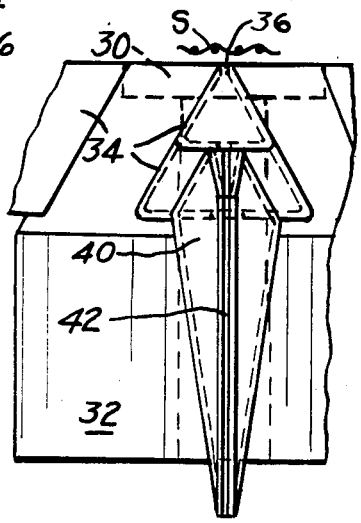
FIG. 4 is an end view of one of the slotted hollow radial arms of the air distributing rotor provided with upper and lower slotted portions, taken on line 4—4 of FIG. 2.

Adjustably mounted on and keyed to rotate with the drive shaft of the lower variable speed drive unit D is an air distributing rotor R including an inner central flanged hub 30 and an outer annular hub 32 from which at least one and preferably a plurality of angularly spaced slotted radial arms or blades 34 extend generally horizontally in the lower collecting chamber. As seen in FIGS. 2 and 4 the rotor R preferably comprises four (4) equally angularly spaced elongated radial arms 34 each of hollow triangular cross sectional shape with an elongated radial slot 36 about 2 mm (0.080") wide extending through the entire upper horizontal apex edge portion thereof situated closely adjacent and spaced from the underside of the screening means S. The fine mesh screen S having uniform openings in a range of 3 to 50 microns spans the lower chamber and is attached to an outer narrow frame about 102 cm (40") in diameter with a projection fitted into a locating groove or recess in and clamped to the outer flange 22 of the lower chamber 20.

Each of the arms 34 have, as shown in FIG. 4, oppositely inclined side walls diverging from the upper slotted apex edge 36 to a slightly inclined bottom wall 38 with or without air passages therein which slopes upwardly and radially outwardly at a slight angle from an inner end portion thereof attached to the top of the outer annular hub or collar 32.

Extending downwardly from a perforated bottom wall 38 of at least one of the hollow radial arms is as shown in FIG. 4 a lower V-shape channel portion 40 defined by oppositely inclined spaced sidewalls extending downwardly and converging toward each other to lower spaced, inclined edges or lower slotted apex edge portions 42 thereof situated adjacent and spaced about 10 mm (0.615") from the inclined conical shape lower or bottom wall of the lower housing. The inner side of the V-shape channel 40 is closed off by the attached collar 32 and hence air must pass out the openings in the bottom wall 38 and out the narrow elongated slots about 1.5 mm (0.060") wide in the lower inclined apex edge portion 42 and fluidize the screened undersize particles falling between the arms 34 of the rotor R and collecting on the inclined lower wall of the conical lower collecting chamber of lower housing 20.

The outer annular collar 32 is spaced from the central drive hub 30 and extends downwardly and rotates around an upwardly projecting central annular bearing wall of the air conduit in the lower support housing 20 and thereby provides an extension of the annular passage or air conduit for conveying air from the blower 16, creating the differential pressure P3, into the inner open end of each of the hollow triangular shape arms 34.

At any one period of time during slow 5 to 20 revolutions per minute (RPM) of rotor R, air flowing at a predetermined volume and creating the water gauge pressure P3, enters each hollow arm 34, passes out the upper narrow elongated radial slots 36 and through adjacent corresponding narrow areas of the perforated screen S above to simultaneously fluidize corresponding angularly spaced narrow elongated radial portions of the layer of particulate material which is collecting on and passing through screen S.

Likewise, part of the first air flow also passes downwardly through the spaced apertures of about 2 mm (0.080) in diameter in the bottom wall 38 of at least one arm 34, through the V-shape chamber and out the elongated slots in the lower inclined apex edge portion 42 of the arm and thereby simultaneously fluidize and prevent the screened under size particles from collecting on the inclined bottom wall of the lower housing 20.

The fluidized particles and first air flow are thereafter mixed with and carried away from the lower chamber and to cyclone CS with the aid of a secondary air flow which are drawn together to create a lower water gauge pressure P2 of from 5 to 20 mm in the lower chamber by the conventional variable motor driven suction fan SF. This combined first and second air flow is also momentarily obstructed every time the lower channel or paddle portion 40 of the arm 34 rotates by the inlet and outlet means and thereby creates turbulence in the lower collecting chamber and assists in removing particulate.

Mounted upon and clamping the frame of the screen S to the flange 22 of the lower housing 20 is an upper conical shape receiving housing 50 comprising an upper conical chamber into which the first air flow enters and combines with a second air flow to create a water gauge pressure P1 of 2 to 10 mm. The chamber is enclosed by an upper inclined wall diverging downwardly and outwardly to an outer wall attached to an upper outer annular flange 52. The lower surface of the horizontal outer flange 52 is preferably provided with a conventional annular seal or O-ring adapted for sealing engagement with the frame of screen S maintained by removable bolts extending between the lower and upper flanges 22 and 52. Alternatively seals may be placed on one or both the lower and upper surface of the screen frame.

At one side of the upper housing 50, the flange 52 extends radially to support a pivot bearing cap or cylinder 56 fixed thereto and attached to a fluid pressure actuated pivot piston and cylinder of a displaceable pivot means or device 60. The pivot device 60 is adapted to raise and lower the upper housing 50 axially off the frame of screen S and allow pivotable movement of the upper housing 50 in order to service, replace or change the screening means S.

A vertical support member extending upwardly from the base B also supports the end portion of the air duct 14 upon and to which a horizontal base or end plate and vertical support cylinder 62 of the displaceable pivot device 60 is fixedly attached.

A piston 64 is slideably mounted for limited axial displacement in a lower bore of the support cylinder 62 and has attached thereto an upwardly extending piston rod 66. The piston rod 66 is slideably mounted in and extends through a smaller upper bore in the upper end of the cylinder 62 to an upper end portion inserted into the pivot bearing cap 56. A conventional two way rotary valve V connectable to a source of fluid under pressure such as hydraulic fluid or compressed air, is provided to actuate the device. Following unbolting and unclamping of the flanges 52 from 22 a partial rotation of the valve V supplies fluid under pressure to the lower end of the cylinder bore, which displaces the piston 64 and piston rod 66 upwardly to a stop shoulder and thereby raises the upper housing sufficiently to remove or change the screen S.

If necessary, the upper housing can also be pivoted about the axis of the piston rod 66 relative to the lower housing by disconnecting the quick disconnect and connect type coupings provided at the material inlet 74 and outlet 76 conduits of the upper support housing 70.

Rotary material distributor and collector means are provided in and supported by an upper central portion of the upper housing 50 for distributing and dispersing particulate material fed thereto onto the screening means S below and to remove oversize particles accumulated on the screen S.

The rotary distributor and collector means comprises a central cylindrical upper support housing 70 fixed to and extending upwardly from a central portion of the top or upper wall surrounding a central inlet opening in the upper wall of the upper receiving housing 50.

Between its opposite upper and lower open ends the upper support housing 70 has extending inwarding from its outer wall an annular web portion supporting a central bearing sleeve 72 which together divide the housing internally into upper and lower annular chambers. An inclined inlet feed conduit 74 extends into the lower annular chamber and an oversize particle outlet conduit 76 extends from the upper annular chamber.

The housing 70 has fixed to its upper open end a second conventional fixed or variable speed motor and gear reduction drive unit D′ with its output drive shaft extending downward and rotatable about a vertical axis coinciding with the central axis of the upper and lower housings 20 and 50.

Attached to and rotatable with the drive shaft of the upper drive unit D′ is fixed a hollow elongated shaft or tubular sleeve 78 rotatably engaging the central bearing 72. The upper end portion of said hollow sleeve 78 has a plurality of outlet passages or apertures in the wall thereof through which oversize particles suspended in a third air flow of about 160 M3/hr. that creates a differential water gauge pressure P4 of about 1000 mm can pass from the interior thereof into and out of the upper annular chamber, through outlet conduit 76 to a second oversize particle cyclone separater collector unit CS′ and, if desired, on to an optionally provided second air filter dust collector unit DC′ and exhaust air through the second variable motor driven suction fan SF′.

Fixed to and flared upwardly and outwardly from the lower open end portion of the sleeve 78 is a perforated cone shape distributor nozzle or funnel 80 rotatable in the lower annular feed inlet chamber below the material feed inlet pipe 74.

Figure 3:
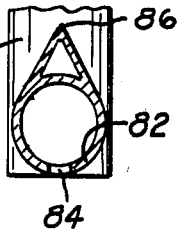
FIG. 3 is a cross sectional view taken on line 3—3 through the oversize particle collecting arm shown in FIG. 2.

Inserted into and adjustably fastened to the lower end of the rotatable hollow sleeve 78 or made an integral part thereof, is the vertical tubular leg of a hollow L-shape rotatable collector arm 82 having a horizontally extending elongated slotted tubular collecting radial arm or leg. The radial collecting arm 82 has as shown in FIG. 3 a continuous narrow elongated slot 84 about 3.2 mm ($\frac{1}{8}$″) wide extending through the tube wall at the bottom thereof situated directly above and spaced about 6.4 mm ($\frac{1}{4}$″) from the adjacent upper side of the static screening means S from which accumulated oversize particles are periodically removed during rotation of collector arm 82 and operation of the suction fan SF′. On the upper side of the horizontal tubular leg of collector arms 82 are inclined sides which diverge downwardly and outwardly from the upper horizontal apex edge 86 thereof for the purpose of deflecting and preventing the accumulation of particles thereon.

As shown in FIG. 1 the feed inlet pipe 74 and outlet pipe 76 are connected to adjacent conduits by an axially movable sleeve type coupling of either flexible or rigid construction which can be displaced sufficiently to quickly connect or disconnect and swing the upper housing 52, and apparatus carried thereby about the pivot support shaft 66 relative to the lower housing in order to service the device and screen S.

Particulate feed means of any conventional type may be provided to feed the material to be screened to the inlet pipe 76. The feed means FM shown has an optionally heated temperature controlled horizontal housing and channel in which a rotatable helical feed screw FS is rotated, at a predetermined variable low speed, about a horizontal axis by a train of gears or pulleys of predetermined speed ratio driven by a variable speed motor M. A feed hopper H at one end holds a quantity of particulate material extruded therefrom and advanced at a suitable uniform rate by the rotating helical feed screw FS through the channel and heated if needed by an induction coil C wrapped about the channel housing. Thus, the particulate material containing a mixture of oversize and undersize particles remains in a dry powder form during the screening process.

In the operational screening or production mode the suction fan SF' which normally draws a third air flow at 160 M3/hr. and water gauge pressure P4 of 1000 mm in the collection arm 82 is shut down and no air is drawn through the particle collecting vacuum arm 82, outlet 76, cyclone CS' and filter DC'. Thus, pressure P4 not present, is equal to P1 in the upper chamber during screening.

During a typical screening operation of material containing up to 30 micron size particles the fan 16 forces a first flow of air at about 800 M3/hr. which creates a differential water gauge pressure P3 of about 40 mm, into each of the hollow arms 34 of the rotor R. The suction fan SF operating at 1000 M3/hr. draws the first and second flow of additional air of about 200 M3/hr.; 100 M3/hr. through each of the feed distributor nozzle and duct 24, into and out of the lower collecting chamber and which combined creates the differential water gauge pressure P2 of about 20 mm. The first air flow passes out the elongated slots 36, in the arms 34 and through 15 micron size openings in the screen, to fluidize narrow elongated radial portions of the material on the screen and then after a pressure drop enters the upper receiving chamber and creates a water gauge pressure P1 of about 10 mm which is greater than P2. Hence, during screening the various sources of air flow are adjusted and regulated to obtain the following differential pressures wherein $P3>P4=P1>P2$.

Variable speed motors D and D1 are started and adjusted to slowly rotate the respective air distributing rotor R at about 12 RPM and the rotary distributor 80 and arm 82 at about 25 RPM. Motor M is started and adjusted to rotate feed screw FS the desired feed rate and heater coil is operated, if necessary, to heat the chamber and dry the material being conveyed to the feed pipe 74 and rotating distributor nozzle or funnel 80. Material to be screened and secondary air of about 100 M3/hr. passes through the perforations in the distributor 80 whereupon the circulation of air through the apparatus creates a partial vacuum and a differential air pressure P1 in the upper chamber greater than P2 in the lower chamber but both lower than the air pressure outside the apparatus. Thus, secondary outside air of about 100 M3/hr. is drawn into and helps the nozzle 80 to uniformily disperse the particulate material onto the screen S and to mix with the first flow of air in the upper receiving chamber.

Since air pressure P1 above the screens is greater than air pressure P2 below the screen, the air currents move downwardly and help the gravitational force carry the particles onto, and to pass, in this case, undersize particles up to 15 microns through the 15 micron openings in non-fluidized segments of the screen S situated between the rotor arms 34. Particles equal to and of smaller size than the openings in the screen then pass with the combined first and secondary air flow into the lower chamber and toward the bottom wall of the lower housing. As the rotor rotates part of the first air flow passes through the perforated inclined bottom wall 38 of preferably one triangular arm 34 and out the inclined slot 42 in the lower portion 40 of each arm 34 at a lower pressure than P3 due to a pressure drop to fluidize the particles collecting on the bottom wall. Hence, the combined first and second air flow and the undersize particles mix with another portion of the second flow of air of 100 M3/hr. passing from inlet 24 and into the lower chamber whereupon they are combined and drawn out by suction fan SF at 1000 M3/hr. This exhaust air flow is momentarily obstructed by the rotating paddle 40 of at least one arm of the rotor and thus causes variations in pressure volume and velocity and hence creates air turbulence in the collecting chamber. Thus, the particles are carried to the cyclone separator CS by the combined air streams whereupon the larger of the undersize particles within a predetermined micron size range are separated from the smaller micron size fines and dust carried to and filtered from the air stream by the filter and dust collector unit DC.

Following a predetermined period of screening the material feed means FM, the second additional air flow and suction fan SF are stopped. The oversize particles that have accumulated on the screen are then removed by starting up the suction fan drive motor SF', which draws the third airstream of about 160 M3/hr. and creates a negative water gauge differential pressure P4 of about 1000 mm in the rotating slotted horizontal arm of the collector 82.

The first air flow at pressure P3 continues to enter and flow from the slotted rotor arms, through openings in the screen and into the upper chamber at a differential pressure P1. Air passing through the screen S agitates the coarse or over size particles until picked up and carried away by the air flowing into the collector arms 82. At this time pressure P4 is less than or equal to the air pressure P2 in the lower chamber.

The air pressure in the various areas of the apparatus during removal of the oversize particle is adjusted and regulated to obtain the following differential pressure conditions wherein $P3>P1>P2\geqq P4$.

Since the air at pressure P3 emerging from the rotating slotted rotor arms is greater than P1 it tends to lift the oversize particles temporarily off the screen S after which the reduced air pressure P1, still greater than P2, helps gravity carry them back onto the screen whereupon the higher volume and lower negative air pressure P4 at rotating collector arm 82 passing over them draws the oversize particles through the narrow elongated slot 84 and carries them out the outlet pipe 76 to the cyclone separator CS'.

The cyclone separater CS' separates and collects the larger oversize particles and allows the smaller oversize particles, if any, to continue on to be separated from the air by the filter and dust collector unit DC'.

From the above description it can be seen that various differential air pressures P1, P2, P3, and P4, created by the various air streams passing through the apparatus are lower than the air pressure outside the apparatus and thereby creates a partial vacuum of various degrees within the apparatus.

As many other embodiments and modifications of invention are possible, it is to be understood that the embodiment disclosed hereinabove is but an example of the many possible embodiments thereof and the invention includes all embodiments, modifications and equivalents thereof falling within the scope of the appended claims.

We claim:

1. Apparatus for screening and separating particulate material comprising:

support means for supporting the apparatus about a central vertical axis thereof including a lower support housing having upper and lower support walls, and an air conduit extending upwardly beyond the upper support wall;

a lower collecting housing mounted on the upper support wall of the support housing and having a lower wall extending around and outwardly from the air conduit and upwardly around a lower collecting chamber to a lower outer flange thereof, and air inlet and outlet means in the lower wall for passing air through the lower collecting chamber;

screening means, with openings of substantially uniform size, extending horizontally above and across the lower collecting chamber and clamped to the lower outer flange;

an air distributor rotor rotatable within the lower collecting chamber and having at least one elongated hollow radial arm extending radially outwardly from a central hub and having an inner open end connected to the air conduit and an upper edge including an upper elongated slot therein, extending horizontally and rotatable a predetermined distance below the screening means;

rotor drive means mounted on the lower support wall of the support housing for rotating the air distributor rotor;

an upper receiving housing situated above the lower housing and having an upper wall extending outwardly and downwardly around an upper receiving chamber to an upper outer flange thereof adapted for clamping an outer portion of the screening means to the lower outer flange;

rotary feed distributor means on the upper receiving housing for distributing particulate material containing oversize and undersize particles into the upper receiving chamber and onto the screening means;

collector means rotatable within the upper receiving chamber and adapted for removing accumulated oversize particles from the screening means;

collector and distributor drive means adjacent the rotary feed distributor means for rotating the feed distributor means and the collector means;

feed means connected to and for feeding the particulate material to be screened and separated to the rotary feed distributor means;

first means connected to the air conduit for supplying a first air flow of predetermined volume and pressure into the air conduit, into each hollow radial arm and out each elongated slot therein and through the screening means to fluidize the particles collecting thereon, up into the upper receiving chamber and back downwardly with and helping to carry the undersize particle through the screening means and into and out of the lower collecting chamber;

second means connected to the air outlet means in the lower wall for drawing the first air flow and an additional second air flow together into and through the lower collecting chamber and out the outlet means for carrying and collecting screened undersize particles therefrom; and third means connected to the collector means for drawing a third air flow of predetermined sufficient volume to remove and carry oversize particles accumulated on the screening means up into and out through the collector means.

2. Apparatus for screening and separating particulate material according to claim 1 wherein at least one of the hollow radial arms of the air distributor rotor further comprises:

a perforated bottom wall portion with a plurality of passages therein situated opposite the upper edge portion and elongated slot; and a pair of spaced side walls extending from the bottom wall and converging downwardly in the lower collecting chamber toward lower spaced edges with a lower elongated slot therebetween, spaced from and extending adjacent the lower wall of the lower collecting housing;

whereby air from the first air flow can pass through the passages in the perforated bottom wall portion thereof and out the lower elongated slot in each radial arm and fluidize the undersize particles collecting on the lower wall of the lower collecting housing.

3. Apparatus for screening and separating particulate material according to claim 1 wherein the rotary feed distributor comprises:

an upper support housing extending from the upper wall of the upper receiving housing and having a lower feed chamber adjacent the upper receiving chamber including a feed inlet and an upper chamber including an oversize particle outlet; and a feed distributor nozzle mounted in the upper support housing for rotation below the feed inlet and at an entrance to the upper receiving chamber.

4. Apparatus for screening and separating particulate material according to claim 3 wherein the collector means comprises:

a hollow collector arm rotatable in the upper receiving chamber and having an oversize particle inlet passage, and an upper open end in communication with the upper chamber and oversize particle outlet thereof.

5. Apparatus for screening and separating particulate material according to claim 4 wherein the hollow collector arm further comprises:

a vertical tubular leg rotatably mounted in the upper support housing and communicating with the upper chamber and oversize particle outlet, and a horizontal tubular collecting leg extending radially outwardly in the upper receiving chamber from a lower end of the vertical tubular leg and rotatable above the screening means and having for the particle inlet passage, an elongated slot in a lower wall portion thereof spaced from and adjacent an upper side of the screening means.

6. Apparatus for screening and separating particulate material according to claim 5 wherein the feed distributor nozzle comprises:

a perforated funnel with feed outlet passages therein.

7. Apparatus for screening and separating particulate material according to claim 6 wherein the rotary feed distributor further comprises:

a hollow tubular sleeve rotatable in a bearing in the upper support housing and coupled at its upper end to a drive shaft of the collector and distributor drive means and having an outlet in an upper wall portion thereof connected to the upper chamber and the oversize particle outlet thereof, and a lower open end portion thereof attached to a lower end of the perforated funnel and to the vertical tubular leg of the collector arm.

8. Apparatus for screening and separating particulate material according to claim 1 further comprising:

displaceable pivot means connected to and operable for lifting and pivoting the upper receiving housing relative to the lower collecting housing.

9. Apparatus for screening and separating particulate material according to claim 8 wherein the displaceable pivot means comprises:

a cylinder fixed relative to the support means and lower collecting housing;

a piston and piston rod slidably mounted within the cylinder and extending upwardly to an upper end portion of the piston rod;

a pivot bearing cap attached to an extension of the outer upper flange of the upper receiving housing and having a bore into which the upper end portion of the piston rod is inserted; and a valve means connected to a source of fluid under pressure and the cylinder to displace the piston and piston rod.

10. Apparatus for screening and separating particulate material according to claim 1 wherein the rotor drive means and the collector and distributor drive means each comprises:

a drive motor and gear reduction unit with drive shafts coupled to rotate the respective air distributor rotor and the rotary feed distributor and collector means.

11. Apparatus for screening and separating particulate material according to claim 1 wherein the first means for supplying the first air flow comprises:

an air blower adapted to supply the first air flow at a lower volume than the combined volume of said first and second air flows drawn out of the lower collecting chambers by the second means and having an air intake, and an air outlet;

a first air filter housing and chamber including a first air filter therein attached to the support means and having an inlet side connected to the air outlet of the blower; and an air duct extending from the air filter housing and chamber to the air conduit in the lower support housing.

12. Apparatus for screening and separating particulate material according to claim 1 wherein the second means for drawing the first and second air flows together into, through, and out the lower collecting chamber at a predetermined volume for carrying and collecting the undersize particles therefrom comprises:

a second air filter chamber including a second air filter therein connected into the inlet means of the lower collecting chamber;

an undersize particle cyclone separator and collector unit connected to the outlet means of the lower collecting chamber;

a first filter and dust collector unit connected to the undersize particle cyclone separator and collector unit; and a first suction fan including an outlet and an intake side connected to the filter and dust collector unit and adapted to draw the first and second air flows together into, through, and out the lower collection chamber at a predetermined greater volume than the volume of the first air flow into the air conduit.

13. Apparatus for screening and separating particulate material according to claim 1 wherein the third means for drawing the third air flow and collecting the oversize particles accumulated on the screen further comprises:

an oversize particle cyclone separator collector unit connected to the oversize particle outlet of the collector means; and a second suction fan having an intake side connected to the oversize particle cyclone separator and collector unit and adapted to draw the third air flow at a predetermined volume and create a differential pressure in the collector means sufficient to vacuum and draw the oversize particles from the screening means into and through the collector means to the oversize particle outlet and carry them to the oversize particle cyclone separator and collector unit.

14. Apparatus for screening and separating particulate material according to claim 1 wherein the feed means comprises:

a feed hopper for receiving the particulate material;

a feed housing including a feed channel extending from the hopper to a feed outlet pipe coupled to the inlet feed pipe of the lower chamber and the rotary feed distributor;

a helical feed screw rotatable in the feed channel;

feed drive means for rotating the helical feed screw; and heating means about the feed channel for optionally heating and drying the particulate material as it is being fed through the feed channel.

15. Apparatus for screening and separating particulate material according to claim 1 wherein the screening means comprises:

an outer frame of predetermined width and height clamped between the upper and lower outer flanges of the upper receiving and lower collecting housings;

a screen of the proper mesh size and openings of uniform size therein stretched across and attached to the outer frame; and locating means on the outer frame and on at least one of the outer upper or lower flanges to locate and retain the screening means in position.

16. A method of screening and separating particulate material comprising the steps of:

supporting a screen with openings of predetermined uniform size therein substantially horizontally between an upper receiving chamber of an upper receiving housing and a lower collecting chamber of a lower collecting housing;

distributing particulate material into the upper receiving chamber and onto the screen;

rotating an air distributor rotor having at least one slotted hollow elongated radial air distributing arm in the lower collecting chamber, with an upper elongated slot therein located below and spaced from the screen;

supplying and passing a first air flow at a predetermined volume and pressure into each rotating radial air distributing arm and out through the slot therein and the openings in the screen to fluidize the particulate material collecting on the screen and into the upper receiving chamber whereupon it is drawn downwardly and helps disperse the distributed particulate material onto the screen and passes with the undersize particles through openings in the screen and into and out of the lower collecting chamber; drawing the first air flow and an additional second air flow of lower volume together into the lower collection chamber wherein the first and second air flows are combined and flow together to remove and carry the undersize particles through and out of the collecting chamber and create a lower air pressure in the lower collecting chamber whereby the first flow of air and any additional second outside air entering the upper receiving chamber at a higher pressure helps to disperse the distributed particles and is drawn downwardly to help gravity carry the undersize particles through the openings in the screen;

periodically stopping distribution of the particulate material into the upper receiving chamber and drawing of the second air flow into the lower collecting chamber;

rotating a slotted tubular oversize particle collector arm, with an elongated bottom slot therein, in the upper receiving chamber and above the screen; and drawing a third air flow of sufficient volume and pressure into and through the collector arm to draw, remove, and carry the oversize particles from the screen, and out of the upper receiving chamber.

17. A method of screening and separating particulate material according to claim 16 wherein the distributing step further comprises:

feeding the particulate material to a rotary distributor rotatably mounted in an upper central portion of the upper receiving housing and chamber; and rotating the rotary distributor to uniformly distribute the particulate material fed thereto into the upper receiving chamber.

18. A method of screening and separating particulate material according to claim 16 wherein the step of rotating an air distributor rotor further comprises:

providing at least one slotted hollow elongated radial air distributing arm with a lower channel portion with a lower elongated slot therein extending along and spaced from a lower wall of the lower receiving housing and through which a portion of the first air flow passes to fluidize the undersize particles collecting on the lower wall of the lower collecting housing and to create turbulance in the air flow in the lower collecting chamber therein.

19. A method of screening and separating particulate material according to claim 16 wherein the step of drawing the first and second air flow comprises:

drawing a greater volume of combined first and second air flow out of the lower chamber than supplied by the first air flow so as to create a pressure differential between the upper receiving and the lower collecting chamber whereby during distribution and screening of the particulate material the pressure in the lower collecting chamber is lower than the air pressure in the upper receiving chamber.

* * * * *